US005771538A

United States Patent [19]

Huppert, Sr.

[11] Patent Number: 5,771,538

[45] Date of Patent: Jun. 30, 1998

[54] LUBRICATED HINGE PIN

[76] Inventor: Norman K. Huppert, Sr., 210 Pelham Rd., Unit #103-B, Fort Walton Beach, Fla. 32547-3643

[21] Appl. No.: 871,283

[22] Filed: Jun. 9, 1997

Related U.S. Application Data

[63] Continuation of Ser. No. 618,923, Mar. 20, 1996, abandoned.

[51] Int. Cl.[6] ..... E05D 11/02

[52] U.S. Cl. ..... 16/274; 16/386

[58] Field of Search ..... 16/274, 273, 386

[56] References Cited

U.S. PATENT DOCUMENTS

| | | | |
|---|---|---|---|
| 1,168,568 | 1/1916 | Rudolff | 16/274 |
| 1,433,095 | 10/1922 | Peary | 16/274 |
| 1,898,936 | 2/1933 | Brawley | 16/274 |
| 2,053,864 | 9/1936 | Cook et al. | 16/274 |
| 2,570,942 | 10/1951 | Hadfield | 16/274 |
| 2,750,620 | 6/1956 | Clarke | 16/274 |
| 3,407,903 | 10/1968 | Sansabrino | 16/274 |
| 4,679,285 | 7/1987 | Ballantyne | 16/274 |

FOREIGN PATENT DOCUMENTS

| | | | |
|---|---|---|---|
| 220959 | 2/1925 | United Kingdom | 16/274 |

*Primary Examiner*—Chuck Mah
*Attorney, Agent, or Firm*—Myers & Associates, Ltd.

[57] ABSTRACT

A lubricated hinge pin having a hollow cylindrical body forming a grease reservoir. A plurality of ports are provided through the cylindrical body to lubricate an object pivotally attached to the pin. A grease fitting is provided at one end of the pin.

5 Claims, 1 Drawing Sheet

LUBRICATED HINGE PIN

This is a continuation of application Ser. No. 618,923 filed Mar. 20, 1996 now abandoned.

BACKGROUND OF THE INVENTION

1. Field of the Invention

This invention relates to hinges and more particularly, to hinge pins having grease ports.

2. Summary of the Prior Art

Hinges are commonplace to attach doors to vehicles, trailers, and buildings and to attach many other objects for pivotal movement. In many environments hinges are exposed to numerous adverse conditions, such as moisture, dust, dirt, and other substances. As a result of such adverse service, hinges are subject to freeze-up, rust, and undue wear. Lubricants, such as grease, are effective agents in increasing the lifetime of the effectiveness of a hinge. It is therefore desirable to provide an improved lubricated hinge capable of preventing rust and freezeup.

SUMMARY OF THE INVENTION

It is therefore an objective of the invention to provide an improved lubricated hinge pin capable of withstanding adverse conditions. The hinge pin of the invention includes a hollow shaft for receiving a lubricating grease and the like. A grease fitting is provided to supply grease to the hinge pin. A plurality of grease parts extend through the pin and supply grease to the attached object, usually one or more rotating knuckles.

DESCRIPTION OF THE PREFERRED EMBODIMENT

Figure 1:
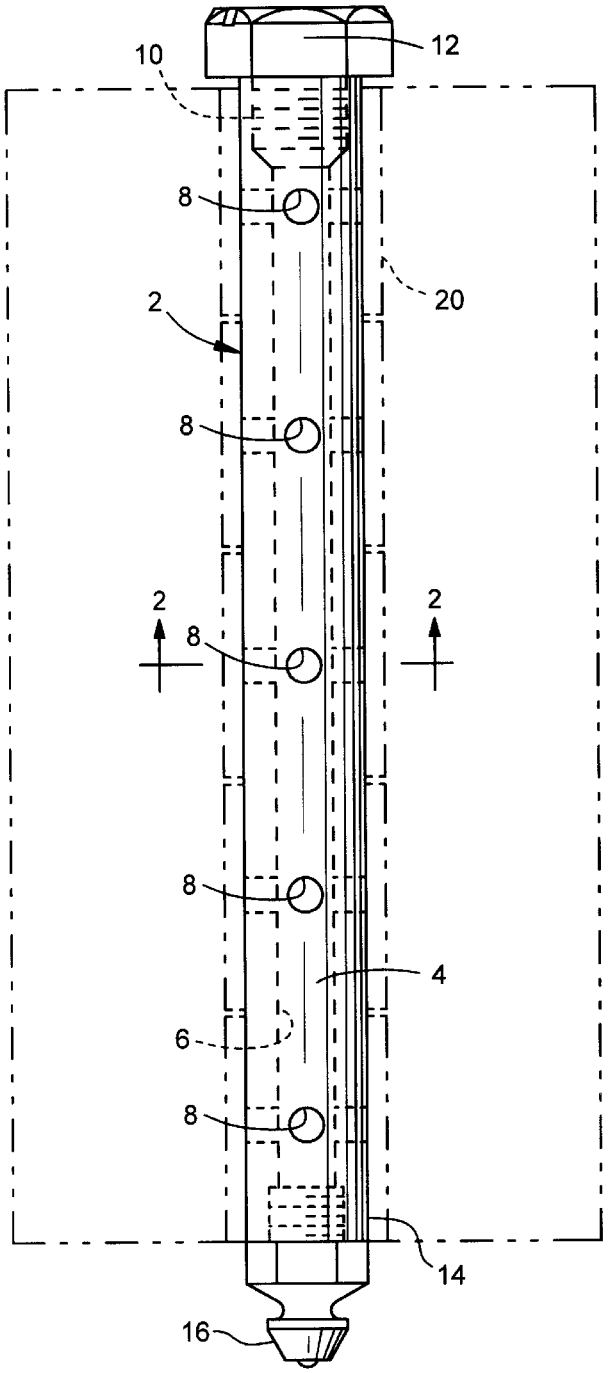
FIG. 1 is a front view of the lubricated hinge pin of the invention showing cooperating parts in phantom.
Figure 2:
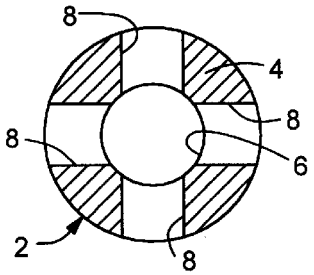
FIG. 2 is a bottom plan view, with parts in section, taken along lines 2—2 of FIG. 1.

Referring now to the drawings, there is illustrated the lubricated hinge pin of the invention, generally designated by reference numeral 2. The hinge pin includes a hollow cylindrical metal body 4 forming a grease reservoir 6 extending substantially along its length. A plurality of grease ports 8 are drilled diametrically through body 4 at 90° angles at a plurality of locations along the pin as best seen in FIGS. 1 and 2. Although four grease ports 8 are shown at each location, it is within the scope of the invention to employ other numbers of ports 8 dependant on conditions and desired results.

Figure 3:
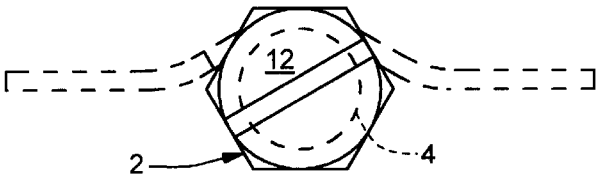
FIG. 3 is a top plan view of the lubricated hinge pin of FIG. 1.
Figure 4:
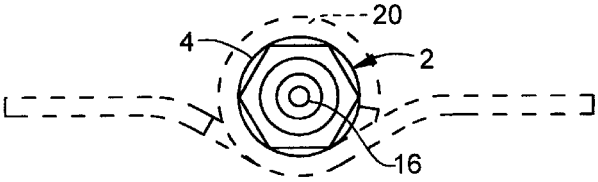
FIG. 4 is a bottom plan view of the lubricated hinge pin of FIG. 1.

As seen in FIGS. 1 and 3 the upper internal end 10 of body 4 is threaded and receives a threaded hexagonal head bolt 12 or other bolt to act as a closure. The upper end can also be closed by a welded closure, a press fit rod and the like (not shown). The bottom end 14 of body 4 is also threaded and receives a threaded grease fitting having a sealable inlet for introducing grease 16 of conventional design, such as, for example, a Zirk fitting. Since the threaded hexagonal head bolt 12 can be removed and the threaded grease fitting 16 can be removed this results in removable closure means at both ends of the cylindrical body 4 for removal of grease therefrom readily by inserting a grease removing instrument through the entire extent of the cylindrical body 4. The pin 2 may pivotally support a plurality of cylindrical knuckles 20. The grease introduced into reservoir 6 is applied at the pivotal contact between the exterior of pin body 4 and the interior of knuckles 20 as best seen in FIG. 4. The ports 8 are only provided in the pin 2 and not in the knuckles.

What is claimed is:

1. A hinge pin assembly for pivotally attaching an object comprising a hollow cylindrical body having opposite ends and forming an internal lubricant reservoir, a plurality of grease ports extending through said cylindrical body to supply grease from said reservoir for lubricating contact between the attached object and the cylindrical body, a grease fitting attached to one of said ends of said cylindrical body to supply grease in said reservoir, said grease fitting normally sealing said cylindrical body and permitting selective introduction of lubricant into said cylindrical body, and removable closure means being substantially axially attached to the other end of said hollow cylindrical body for removal of grease therefrom, said grease fitting having an inlet for selectively introducing grease into and removal of grease out of said cylindrical body, and said inlet of said grease fitting being sealed in use.

2. The hinge pin assembly according to claim 1 wherein said plurality of grease ports include a plurality of grease ports at a plurality of locations along the length of said hollow cylinder.

3. The hinge pin assembly according to claim 2 wherein said plurality of grease ports at said plurality of location are diametrically arranged with respect to each other.

4. The hinge pin assembly according to claim 3 wherein said plurality of grease ports at said locations are arranged at 90° to each other, said grease fitting being a Zerk fitting.

5. The hinge pin assembly according to claim 1 further including a knuckle attached to said cylindrical body in pivotal contacting relationship, said grease ports supply grease to said contacting relationship.

* * * * *